US008613543B2

(12) United States Patent
Lindblom et al.

(10) Patent No.: US 8,613,543 B2
(45) Date of Patent: Dec. 24, 2013

(54) UNDER DRUM WATER TANK

(75) Inventors: Thomas G. Lindblom, Claremont, MN (US); Bryan S. Datema, Rochester, MN (US); Ryan J. Roudebush, Rochester, MN (US)

(73) Assignee: McNeilus Truck and Manufacturing, Inc., Dodge Center, MN (US)

( * ) Notice: Subject to any disclaimer, the term of this patent is extended or adjusted under 35 U.S.C. 154(b) by 1001 days.

(21) Appl. No.: 11/955,737

(22) Filed: Dec. 13, 2007

(65) Prior Publication Data

US 2009/0154287 A1 Jun. 18, 2009

(51) Int. Cl.
*B28C 5/42* (2006.01)

(52) U.S. Cl.
USPC ..... 366/40; 220/636; 220/669

(58) Field of Classification Search
USPC ..... 220/4.14, 4.15, 562–564, 636, 669, 220/674, 914; 280/833; 366/40, 54, 57, 366/59–63
See application file for complete search history.

(56) References Cited

U.S. PATENT DOCUMENTS

| | | | | | |
|---|---|---|---|---|---|
| 422,717 | A * | 3/1890 | Caldwell | 220/611 |
| 1,207,279 | A * | 12/1916 | Crum | 220/636 |
| 1,650,457 | A * | 11/1927 | Macy | 220/574.3 |
| 1,763,249 | A * | 6/1930 | Morris | 366/57 |
| D133,850 | S * | 9/1942 | Clements et al. | D23/211.1 |
| 2,556,034 | A * | 6/1951 | Gerst | 366/40 |
| 2,639,112 | A * | 5/1953 | Cushman | 108/56.3 |
| 2,676,003 | A * | 4/1954 | Oury | 366/61 |
| 3,190,621 | A * | 6/1965 | Rowland et al. | 366/68 |
| 3,767,171 | A * | 10/1973 | Dunmire | 366/30 |
| 3,931,907 | A * | 1/1976 | Henle | 220/530 |
| 4,544,275 | A | 10/1985 | Hudelmaier | |
| 4,585,356 | A | 4/1986 | Hudelmaier | |
| 5,261,739 | A | 11/1993 | da Costa Goncalves et al. | |
| 5,310,080 | A * | 5/1994 | Figge, Sr. | 220/563 |
| 5,361,929 | A * | 11/1994 | McLain et al. | 220/562 |
| 5,673,940 | A * | 10/1997 | Gaisford et al. | 280/834 |
| 5,853,103 | A * | 12/1998 | Yamazaki | 220/562 |
| 6,109,310 | A * | 8/2000 | Peotter | 141/7 |
| 6,123,216 | A * | 9/2000 | Yokocho et al. | 220/564 |
| 6,244,459 | B1 * | 6/2001 | Bouc et al. | 220/630 |
| 6,578,727 | B2 * | 6/2003 | Schmidt et al. | 220/562 |
| 6,651,764 | B2 * | 11/2003 | Fournier et al. | 180/190 |
| 6,715,195 | B2 * | 4/2004 | Erickson | 29/434 |
| 6,782,925 | B2 | 8/2004 | Raposo et al. | |
| 6,802,430 | B2 * | 10/2004 | Tomimura et al. | 220/562 |
| 6,866,944 | B2 * | 3/2005 | Nakazawa et al. | 428/626 |
| 7,581,557 | B2 * | 9/2009 | Lindblom et al. | 137/259 |
| 7,743,862 | B2 * | 6/2010 | Togawa et al. | 180/68.4 |
| 2004/0089666 | A1 * | 5/2004 | Nakazawa et al. | 220/562 |
| 2007/0189108 | A1 * | 8/2007 | Lindblom et al. | 366/30 |
| 2008/0173372 | A1 * | 7/2008 | Lindblom et al. | 141/94 |
| 2008/0205188 | A1 * | 8/2008 | Lindblom et al. | 366/44 |
| 2009/0283530 | A1 * | 11/2009 | Lindblom et al. | 220/564 |

* cited by examiner

*Primary Examiner* — David Sorkin
(74) *Attorney, Agent, or Firm* — Foley & Lardner LLP

(57) ABSTRACT

An on-board auxiliary tank system for supplying makeup water and chemical additives to a transit concrete mixing vehicle is disclosed. The system includes a water tank having a sloped, generally concave upper section, spaced sides and a bottom designed for deployment nested beneath a mixing drum of a transit concrete mixing vehicle and defining a water compartment and a pair of elongate support block members for supporting the water tank situated beneath the sides of the tank and adapted to be attached thereto by removable latch fasteners. The block members include elements suitable for fastening the blocks to a concrete mixing vehicle.

20 Claims, 5 Drawing Sheets

UNDER DRUM WATER TANK

CROSS-REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates generally to vehicle-mounted concrete mixing and dispensing systems including incline-mounted mixing drums and, more particularly, to on-board auxiliary fluid supply systems employed to supply water for washout or adding water and/or chemical additive to a concrete mix. Specifically, the present invention relates to a lightweight auxiliary tank for a fluid supply system shaped to nest beneath a raised portion of an associated inclined vehicle-mounted mixing drum and enables the addition of water and/or chemical additives to the drum or water to clean the drum from a compact on-board supply.

II. Related Art

Transit concrete mixing trucks, sometimes referred to as ready-mix trucks, have long been in use. They are equipped with large chassis-mounted rotatable mixing drums for mixing and dispensing a quantity of concrete. The drums typically are mounted on an incline and have an opening in the upper end for receiving ingredients to be mixed and discharging mixed concrete products. Loading is accomplished through a charge hopper which extends a distance into the opening of the drum. The drum is further provided with internal helical flights or fins extending around its internal surface which act to propel material forward and mix the concrete ingredients when the drum is caused to rotate in one direction and cause the mixed concrete to be discharged from the opening when the rotation of the drum is reversed. The lower portion of the drum includes a ring and roller system for drum support and rotation and the upper portion is carried by a heavy pedestal support assembly.

The trucks are generally further equipped with auxiliary water supply systems including supply tanks and distribution systems mounted on the trucks. These systems are necessary for several reasons. After mixing and discharge, the mixing drums retain an amount of residual concrete on the mixing fins and inner drum surface and discharge chutes which needs to be periodically washed out to prevent it from curing and hardening inside the drum and on external chutes. Therefore, it has become part of the operating routine to wash the interior of the drum and the discharge chutes one or more times per day. In addition, it is routinely necessary to add additional makeup water to adjust slump and/or amounts of chemical additives to concrete batches mixed in the drum prior to discharge.

Auxiliary water supply systems have included a water tank that has been typically pressurized to 50 psi or higher by a supply of air from a compressor carried on the truck. This, in turn, supplies water under pressure for washout or other uses through hoses and a valving system in a well-known manner. Alternatively, more recently, the pressurized system may be replaced by a pump assembly which eliminates the need to pressurize the tank.

To date, most auxiliary water tanks that have been used have been rather heavy metal structures which both are heavy and may add corrosion problems to the system. While aluminum tanks have been used and may reduce weight and corrosion problems, they remain relatively more expensive which is an additional drawback. Thus, there remains a need for an on-board auxiliary water supply and storage system that includes a relatively lightweight and inexpensive tank which does not corrode.

In addition, because space is at a premium for auxiliary on-board devices in transit concrete mixers, there also exists a definite need for an on-board auxiliary water tank that is located in an out-of-the-way unused location.

SUMMARY OF THE INVENTION

By means of the present invention, there is provided an auxiliary water supply system container or tank specifically configured to be disposed beneath a raised portion of a concrete mixing drum associated with a transit concrete mixing truck. The auxiliary water tank is fabricated of a polymeric material that is relatively lightweight and which will remain stable over time. The tank may be configured to be compatible with any on-board water distribution system and it is preferably designed to be compatible with a pumped system. Such a system may include a top discharge, bottom draw output system which includes a draw tube which is designed to connect to an external pumping system in a well known manner. The use of a pump obviates any need to pressurize the tank.

The water tank compartment is provide with a liquid level indicator which may be a transparent sight gauge and which may be calibrated in terms of volume and the compartment is generally provided with a single top fill capability. The tank is provided with a clamp down-type mounting system to removably fix it to the chassis of the transit concrete mixer.

BRIEF DESCRIPTION OF THE DRAWINGS

In the drawings, wherein like numerals depict like parts throughout the same.

DETAILED DESCRIPTION

An embodiment of the present invention will be described with reference to certain drawing figures. They represent an example of an under-drum auxiliary water supply system for a transit concrete mixing truck which provides high pressure water for washout or additional water to be added to a mix in the drum. The embodiment described is meant as an example and not intended to limit the inventive concept in any manner.

It is an important aspect of the present invention that the limited space for auxiliary devices to be mounted on a transit concrete mixing truck be judiciously used. In accordance with another aspect of the invention, the auxiliary water tank of the invention is designed to be lightweight and stable when fixed in place, yet easily removed and reinstalled as desired. In addition, the auxiliary water tank of the invention is advantageously readily accommodated as an article of retrofit on existing transit concrete mixing vehicles.

Figure 1:
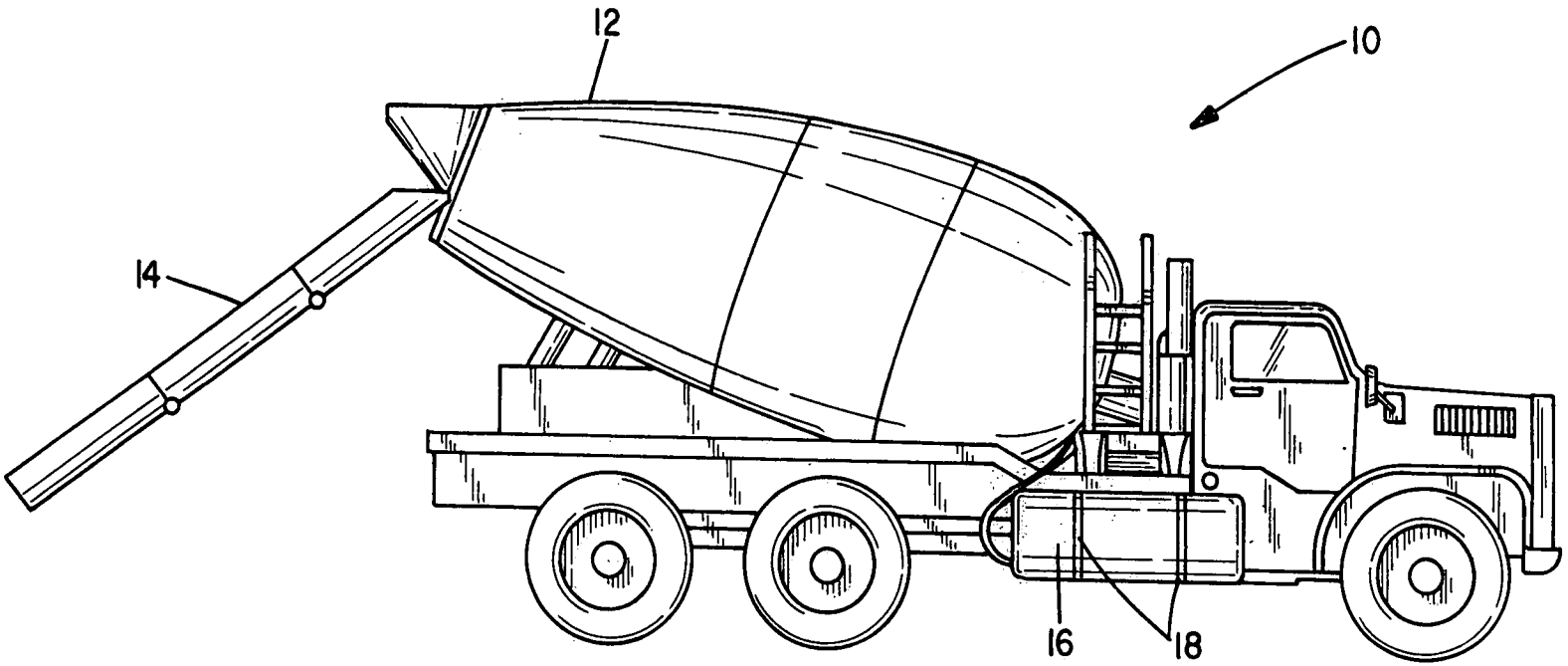
FIG. 1 (PRIOR ART)
FIG. 1 is a side elevational view of a transit concrete mixing truck carrying an auxiliary water system in accordance with the prior art.

A prior auxiliary water tank is illustrated in FIG. 1 in which a concrete mixer truck, generally at 10 having a mixing drum 12 and a discharge chute 14, is provided with a pressurizable auxiliary water tank 16 mounted on the vehicle. As can be seen in the figure, the tank protrudes from the side of the vehicle and is held on with a pair of strap devices 18. On the other hand, the auxiliary water tank of the present invention is designed to be hidden under the rotary concrete mixing drum in normally unused space, as will be described, and is as such out of the way.

Figure 2:
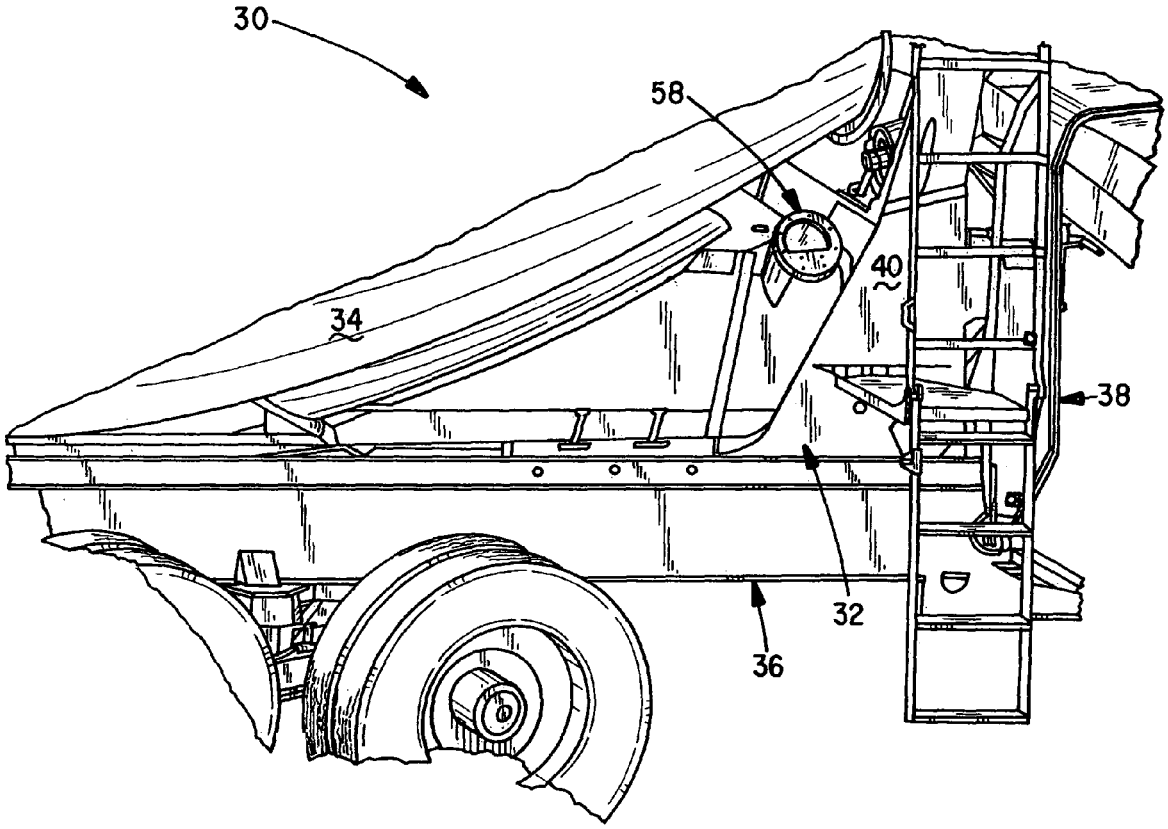
FIG. 2 is an enlarged fragmentary perspective view showing a part of a transit concrete mixer truck equipped with the under drum auxiliary water tank of the invention.

FIG. 2 is a fragmentary perspective view showing part of a transit concrete mixer truck generally at 30 equipped with the under drum water tank of the invention shown generally at 32 neatly tucked under the rotary mixing drum 34 of the truck 30. One longitudinal main truck chassis beam is shown at 36 and an access ladder is shown at 38. A rear drum support pedestal is also shown at 40.

Figure 3:
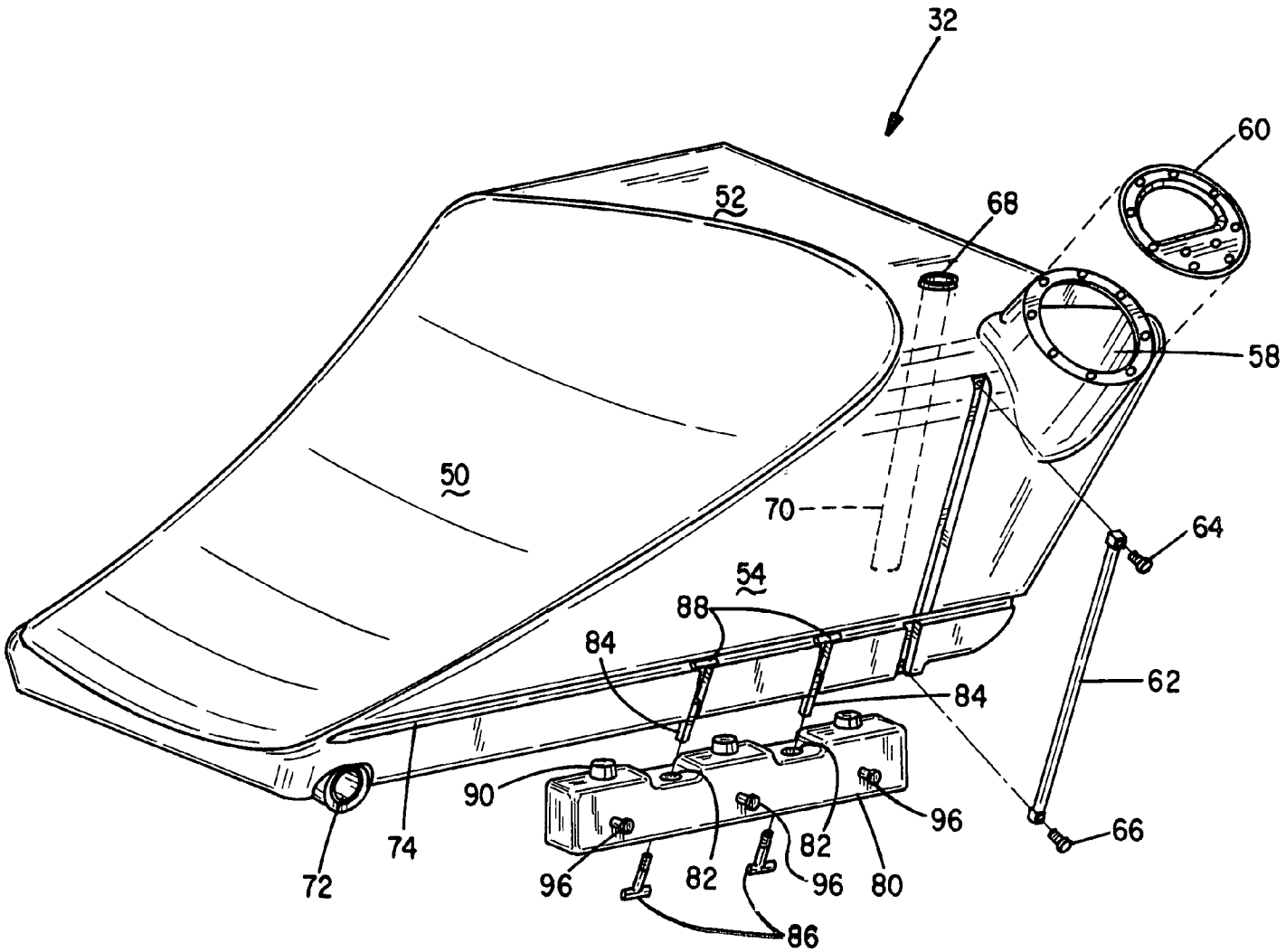
FIG. 3 is an enlarged exploded top perspective view of the auxiliary water tank of FIG. 2 including one side mounting block.
Figure 4:
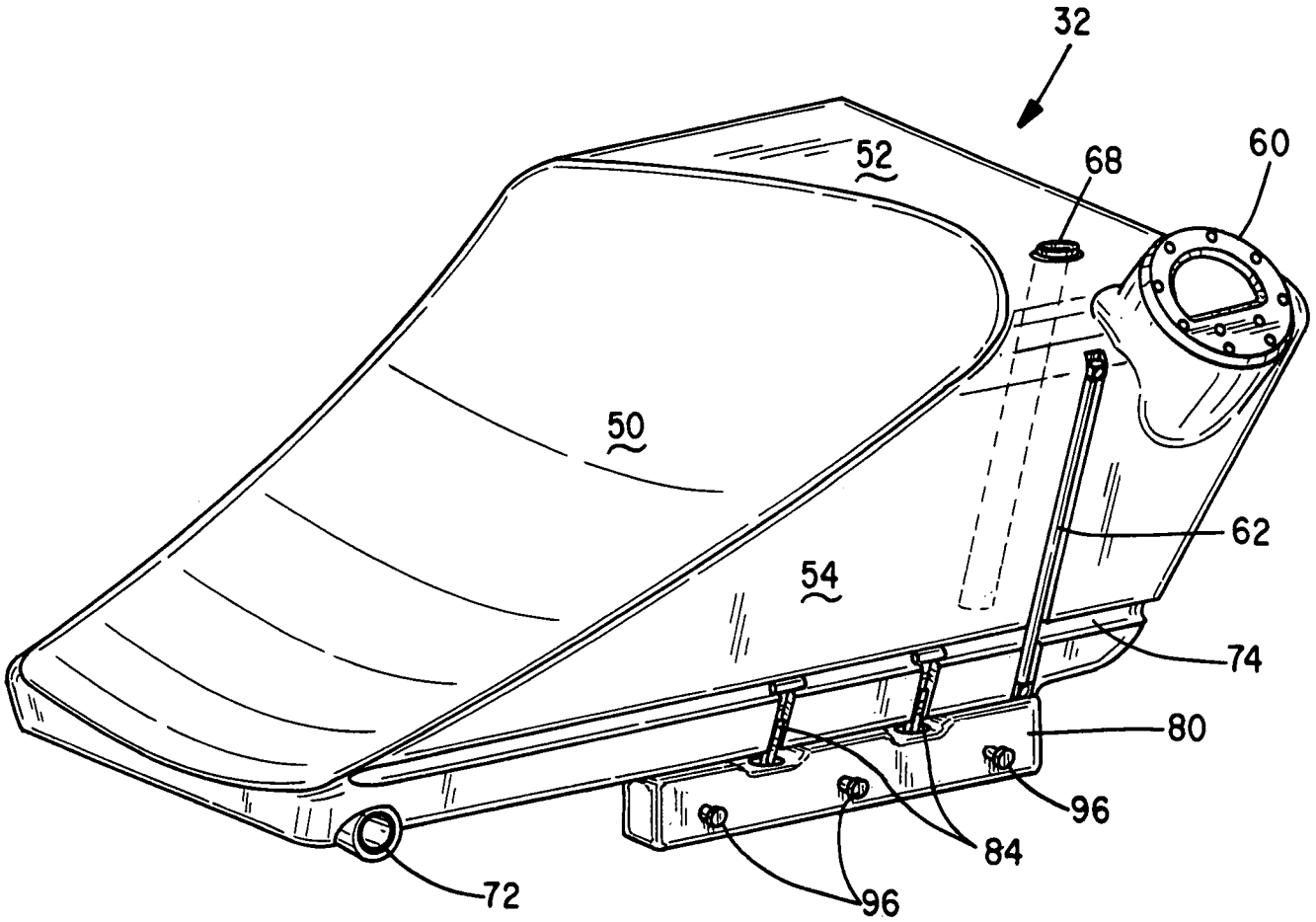
FIG. 4 is a view similar to FIG. 3 showing the tank as assembled and connected to the side mounting block.
Figure 5:
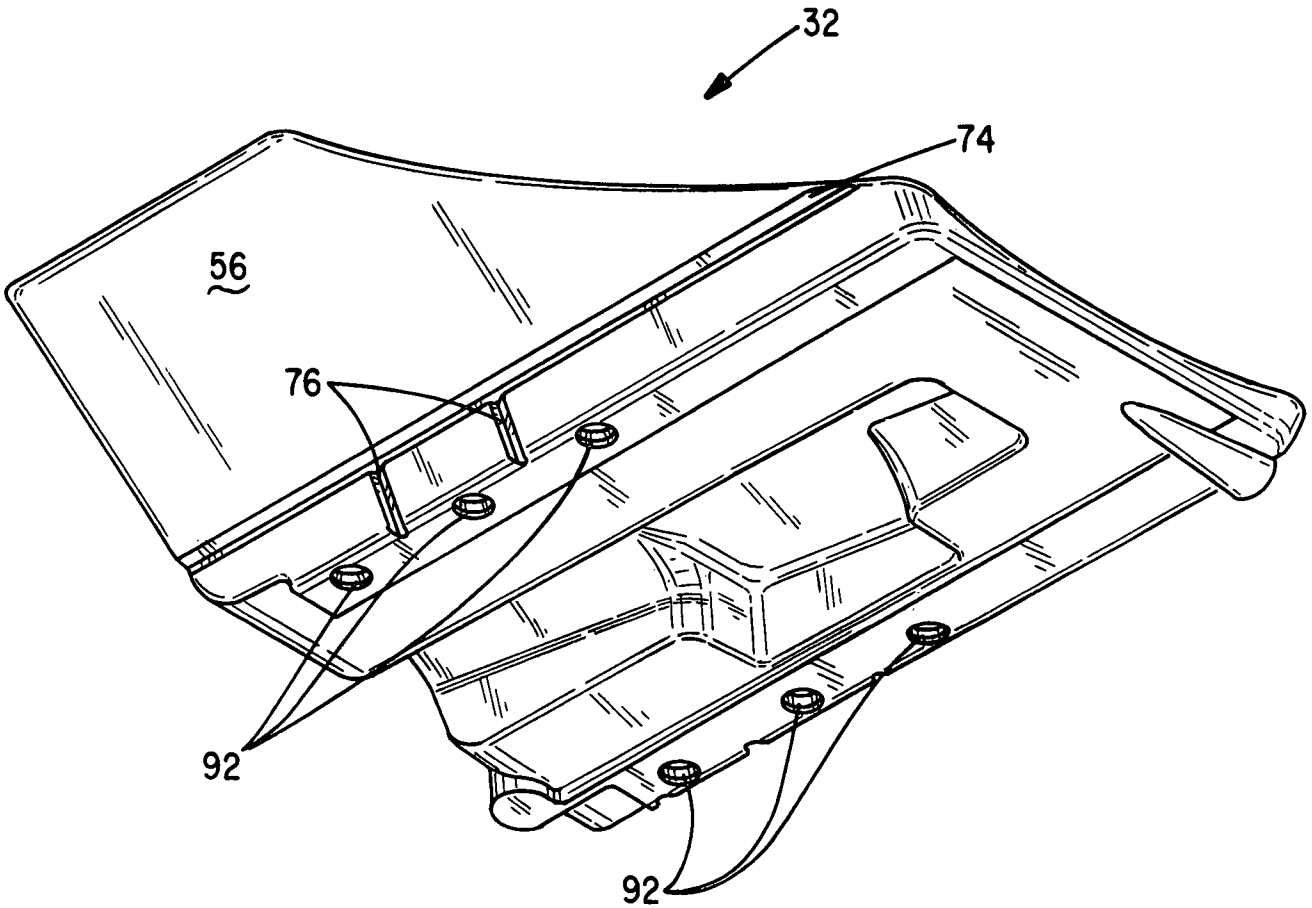
FIG. 5 is a bottom perspective view of the auxiliary water tank of the invention.

The under drum auxiliary water tank itself is depicted in greater detail in FIGS. 3-5. FIG. 3 is an exploded view showing an auxiliary water tank 32 shaped to be accommodated beneath conventional rotary concrete mixing and dispensing drum 34 and includes a sloping, generally concave arcuate front section 50 which blends into a generally flat top at 52. The front and top sections span two spaced sides 54 and 56 (shown in the bottom perspective view of FIG. 5). A fill port is provided at 58 with a cover shown at 60 and a liquid level sight gauge is shown at 62 with attaching bolts at 64 and 66. The sight gauge may preferably be graduated in liquid volume with respect to the contents of the tank at a particular level. A top discharge opening is shown at 68 which is suitable for use with bottom draw tube shown by the dash lines at 70 in a well known manner. A bottom discharge port or drain is depicted at 72.

The tank further includes a pair of longitudinal, generally horizontal bottom grooves or recesses, as at 74 along the sides of the tank and a pair of spaced, generally vertically disposed recesses or slots 76 (FIG. 5) for removably mounting and supporting the tank on the truck. The tank is supported by and removably fixed to a pair of shaped elongate support blocks, one of which is shown at 80 in FIGS. 3 and 4, and which further includes a pair of spaced openings 82 which accommodate internally threaded hollow fastener clamping devices or latches 84 which, in turn, are designed to be secured by threaded members 86 through openings 82. The fastener clamping devices 84 have heads 88 which are accommodated in the grooves 74 and shafts accommodated in recesses or slots 76. The clamping device 84 and members 86 combine to fix the tank 32 to support block members 80. The blocks 80 contain further spaced protuberances or knobs 90 which are, in turn, accommodated in recesses 92 in the bottom of the tank as shown in FIG. 5. This further positions and stabilizes the tank as mounted to the blocks. The blocks, in turn, may be mounted on the truck to chassis structural members as at 94 in FIG. 2 using bolts shown at 96. This produces a very stable yet readily disassembled mounting system for the tank 32.

As can be seen from the figures, the tank 32 is totally accommodated in the space beneath the mixing drum and is shaped in accordance with the space available beneath the mounted drum. In addition, the tank does not protrude into space which can be utilized for other associated auxiliary devices. The tank can be readily connected with an on-board water pumping and distribution system in a well known manner and is easily connected and disconnected in place. The fill port 58 as shown in FIG. 2 is readily accessed from outside of the truck.

The tank 32 may be molded of any stable, relatively high strength polymer material such as, for example, polyethylene. Successful models have been molded from high density polyethylene (HDPE) and this may be a preferred material. Other materials which are tough, chemically inert to the contents, which may include chemical additives, and can withstand the outdoor temperature swings are also suitable. The fastening latch devices 84 and the threaded members 86 are preferably metal, but may also be made from a high strength plastic material such as a polyamide, particularly a nylon.

The tanks 32 may be any convenient size and shape and may be custom fit with regard to the drum mounting of particular truck models. In addition, the auxiliary water tanks of the invention can be readily retrofitted and mounted on existing vehicles. In one typical embodiment, the water tank 32 is one with 135 gallon (511.3 liter) capacity.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. An on-board tank system for supplying makeup water and chemical additives to a transit concrete mixing vehicle comprising:

(a) a water tank having a sloped, generally concave upper section, spaced sides and a bottom designed for deployment nested beneath a mixing drum of a transit concrete mixing vehicle and defining a water compartment; and (b) a tank mounting arrangement including a pair of separate elongate mounting block members disposed in spaced relation beneath said tank and removable threaded clamp fasteners attaching said tank to said separate block members, said block members including elements suitable for fastening said blocks to a concrete mixing vehicle, wherein the upper surfaces of said elongate mounting block members include a plurality of spaced raised knobs and wherein the bottom of said tank includes corresponding recesses for accommodating said knobs when said support blocks are assembled to said tank.

2. An apparatus as in claim 1 wherein said tank is provided with longitudinal recessed grooves extending along the sides thereof and wherein said clamp fasteners have shaft shapes and integral head members that attach to said tank by nesting in said grooves.

3. An apparatus as in claim 1 wherein said shaft shapes of said clamp fasteners include threaded portions and are secured through openings in said support blocks by threaded retainers.

4. An on-board tank system for supplying makeup water and chemical additives to a transit concrete mixing vehicle comprising:

(a) a water tank having a sloped, generally concave upper section, spaced sides and a bottom designed for deployment nested beneath a mixing drum of a transit concrete mixing vehicle and defining a water compartment, wherein said tank is provided with longitudinal recessed grooves extending along the sides thereof; and (b) a tank mounting arrangement including a pair of separate elongate mounting block members disposed in spaced relation beneath said tank and removable threaded clamp fasteners attaching said tank to said separate block members, said block members including elements suitable for fastening said blocks to a concrete mixing vehicle, wherein the upper surfaces of said elongate mounting block members include a plurality of spaced raised knobs and wherein the bottom of said tank includes corresponding recesses for accommodating said knobs when said support blocks are assembled to said tank, wherein the removable threaded clamp fasteners have shaft shapes and integral head members that attach to said tank by nesting in said grooves and wherein said shaft shapes include threaded portions and are secured through openings in said support blocks by threaded retainers.

5. An apparatus as in claim 1 further comprising threaded fastening elements for attaching said elongated support blocks to a truck.

6. An apparatus as in claim 1 wherein said tank comprises a polymer material.

7. An apparatus as in claim 6 wherein said tank and said elongate support blocks are constructed using the same polymer material.

8. An apparatus as in claim 6 wherein said tank is molded from high density polyethylene.

9. The system of claim 1, the tank including generally vertical slots for removably mounting and supporting the tank on the truck.

10. The system of claim 9, wherein the generally vertical slots are shaped to accommodate the shaft shapes of the clamp fasteners.

11. The system of claim 1, the water tank further comprising a liquid level sight gauge coupled to at least one of the spaced sides.

12. The system of claim 1, the water tank further comprising a top discharge opening and a bottom discharge port.

13. The system of claim 4, further comprising threaded fastening elements for attaching said elongated support blocks to a truck.

14. The system of claim 4, wherein the tank comprises a polymer material.

15. The system of claim 14, wherein the tank and the elongate mounting block members are constructed using the same polymer material.

16. The system of claim 14, wherein the tank is molded from high density polyethylene.

17. The system of claim 4, the tank including generally vertical slots for removably mounting and supporting the tank on the truck.

18. The system of claim 17, wherein the generally vertical slots are shaped to accommodate the shaft shapes of the clamp fasteners.

19. The system of claim 4, the water tank further comprising a liquid level sight gauge coupled to at least one of the spaced sides.

20. The system of claim 4, the water tank further comprising a top discharge opening and a bottom discharge port.

* * * * *